US006133224A

United States Patent [19]

Angell et al.

[11] Patent Number: 6,133,224

[45] Date of Patent: Oct. 17, 2000

[54] PROCESS FOR MAKING A FREE-FLOWING PARTICULATE DYE TRANSFER INHIBITING DETERGENT ADMIX

[75] Inventors: Adrian John Waynforth Angell, West Chester, Ohio; Gary Ray Cutter, Hebron, Ky.; Robert Gary Welch, Cincinnati, Ohio

[73] Assignee: The Procter & Gamble Company, Cincinnati, Ohio

[21] Appl. No.: 09/331,303

[22] PCT Filed: Dec. 5, 1997

[86] PCT No.: PCT/US97/22942

§ 371 Date: Jun. 18, 1999

§ 102(e) Date: Jun. 18, 1999

[87] PCT Pub. No.: WO98/28397

PCT Pub. Date: Jul. 2, 1998

Related U.S. Application Data

[60] Provisional application No. 60/033,136, Dec. 20, 1996.

[51] Int. Cl.[7] ..... C11D 11/00; C11D 3/37

[52] U.S. Cl. ..... 510/444; 510/360; 510/475; 510/500; 510/503; 510/513; 510/531; 510/532

[58] Field of Search ..... 510/444, 360, 510/475, 500, 503, 513, 531, 532

[56] References Cited

U.S. PATENT DOCUMENTS

| | | | |
|---|---|---|---|
| 4,006,092 | 2/1977 | Jones | 510/513 |
| 4,414,130 | 11/1983 | Cheng | 510/532 |
| 5,259,994 | 11/1993 | Welch et al. | 510/348 |
| 5,691,297 | 11/1997 | Nassano et al. | 510/444 |
| 5,849,684 | 12/1998 | Donoghue et al. | 510/513 |

FOREIGN PATENT DOCUMENTS

| | | |
|---|---|---|
| 0327927 | 8/1989 | European Pat. Off. . |
| 0677580 | 10/1995 | European Pat. Off. . |

*Primary Examiner*—Lorna M. Douyon
*Attorney, Agent, or Firm*—Brian M. Bolam; Kim Wiliiam Zerby; Steven W. Miller

[57] ABSTRACT

Process for making a free-flowing, particulate dye transfer inhibiting detergent admix for inclusion in a granular laundry detergent composition consisting essentially of the steps of: charging from 50% to 95%, by weight of the dye transfer inhibiting detergent admix, of a detergent builder into a mixer/granulator; adding to the detergent builder from 5% to 50%, by weight of the dye transfer inhibiting detergent admix, of a dye transfer inhibitor solution to thereby form a mixture; and agglomerating the mixture of the dye transfer inhibitor solution and the detergent builder so as to form the dye transfer inhibiting detergent admix.

10 Claims, No Drawings

PROCESS FOR MAKING A FREE-FLOWING PARTICULATE DYE TRANSFER INHIBITING DETERGENT ADMIX

This application claims the benefit of U.S. Provisional Application Ser. No. 60/033,136, filed Dec. 20, 1996.

FIELD OF THE INVENTION

The present invention generally relates to a process for making a free-flowing, particulate dye transfer inhibiting detergent admix to supplement granular laundry detergent formulations. More particularly, the invention relates to a process of mixing a dye transfer inhibitor solution with a detergent builder, and thereafter, agglomerating the mixture in a mixer/granulator so as to form particulate dye transfer inhibiting detergent admix particles.

BACKGROUND OF THE INVENTION

The problem of dye transfer during laundry wash operations is common. There are two general mechanisms by which dyes are transferred during laundry washing. In the first method, certain dyes in colored fabrics tend to bleed directly into the wash solution. When the wash solution is agitated, these suspended dyes can be dispersed through the wash water and may eventually redeposit onto the surface of other fabrics in the wash solution. A common example of this phenomenon is the white garment turned pink after being washed with a red-colored garment. Another way whereby dyes are transferred in laundry wash solutions is for the dyes to bleed onto nearby areas of the same fabric. An example of this is the striped shirt or dress that, after laundering, has blended colors at the edges of the previously distinct stripes. Both of these highly undesirable results can be avoided by using a laundry detergent containing dye transfer inhibitors.

Dye transfer inhibitors are specialized compounds that are useful in preventing fabric dyes from redepositing or bleeding onto other fabrics. Dye transfer inhibitors can reduce dye transfer problems by complexing with suspended dyes to keep the dyes suspended in the wash solution, thereby preventing the dyes from redepositing once they leave the fabric surface. Dye transfer inhibitors may also function to prevent the initial bleeding of dyes from the fabrics. This not only reduces the undesired dye transfer problems but also helps preserve the color brightness of the fabrics over repeated washings.

Dye transfer inhibitors are generally organic polymers with melting points close to room temperature. Laundry detergent manufacturers usually incorporate dye transfer inhibitors into granular laundry detergents by spraying a viscous solution of dye transfer inhibitors onto the detergent granules near the end of the manufacturing process. However, there are several difficulties associated with dye transfer inhibitor spray-on procedures. First, spray-on can be expensive if special pumps are required to handle the viscous dye transfer inhibitor solutions. Second, excessive spray-on can make the granules sticky, causing the detergent granules to "gum up" into clumps which impede product flow. In addition to increasing manufacturing costs due to poor flow and handleability, clumps of sticky detergent are unappealing to consumers. Third, when sprayed, dye transfer inhibitors often give off an unpleasant odor which interferes with perfumes previously incorporated into the detergent granules. Fourth, control of the final product color is more difficult because certain dye transfer inhibitors turn pink in higher pH environments, thus necessitating the need to strictly control pH parameters in the spray-on step.

Thus, there has long been a need in the industry for an alternative process for manufacturing granular laundry detergents containing dye transfer inhibitors. Attempts to resolve the problems associated with spraying dye transfer inhibitors onto laundry detergent granules have largely involved variations in temperature, dye transfer inhibitor solution strength, and pH levels. These attempts, however, have failed to produce a dependable manufacturing process. Moreover, certain materials capable of functioning as dye transfer inhibitors, such as copolymers of N-vinylpyrrolidone and N-vinylimidazole, are explosive in dry, powdered form. Processes that avoid the messy spray-on procedures by employing these dry powders require costly equipment to safeguard against potentially dangerous explosions.

Accordingly, a new process that provides for a free-flowing dye transfer inhibiting detergent admix for addition to laundry detergent granules is desired. It is desired that the process for making the dye transfer inhibiting detergent admix be safe and cost-efficient. Furthermore, it is also desirable that such a process yield dye transfer inhibiting particles that are both aesthetically pleasing to the consumer and, when admixed with detergent granules, support a laundry product that is tinctured with a pleasant scent.

BACKGROUND ART

The following references relate to detergents with dye transfer inhibiting properties: U.S. Pat. No. 5,466,802 (Panandiker et al., 1995); U.S. Pat. No. 4,545,919 (Abel et al., 1985); U.S. Pat. No. 5,478,489 (Fredj et al., 1995); and U.S. Pat. No. 5,451,341 (White et al., 1995). The following references relates to agglomerating detergent granules: U.S. Pat. No. 5,565,137 (Capeci et al., 1996); U.S. Pat. No. 5,489,392 (Capeci et al., 1996); U.S. Pat. No. 5,486,353 (Capeci et al., 1996); and U.S. Pat. No. 5,366,652 (Capeci et al., 1994). The following references relate to detergent granules, the solubility thereof and/or the flow properties of such granules: U.S. Pat. No. 4,715,979 (Moore et al., 1987); U.S. Pat. No. 5,009,804 (Clayton et al., 1991); U.S. Pat. No. 4,006,110 (Kenny et al., 1977); U.S. Pat. No. 5,149,455 (Jacobs et al., 1992) and U.S. Pat. No. 4,637,891 (Delwel et al., 1987). The following references provide useful information on making detergent admixes: U.S. Pat. No. 5,259,994 (Welch et al., 1993); and U.S. Pat. No. 4,414,130 (Cheng et al., 1983).

SUMMARY OF THE INVENTION

The present invention meets the above-identified industry need for an alternative method of incorporating dye transfer inhibitors into granular laundry detergent products by providing a process for making dye transfer inhibiting admix particles. The claimed process provides for admix particles that are free-flowing and easily handleable. In addition, the process provides for a dye transfer inhibiting admix that does not interfere with the perfumes of the granular laundry products to which the admix is added. The claimed process is also economical to operate because it does not require special pumps to handle viscous dye transfer inhibitors, nor does it require special equipment to protect against possible explosions of certain dye transfer inhibitors.

In accordance with one aspect of the invention, a process for making a free-flowing, particulate dye transfer inhibiting detergent admix for inclusion in a granular laundry detergent composition is provided. Specifically, the process comprises the steps of charging from about 50% to about 95%, by weight of the dye transfer inhibiting detergent admix, of a detergent builder into a mixer/granulator, adding to the detergent builder from about 5% to about 50%, by weight of the dye transfer inhibiting detergent admix, of a dye transfer inhibitor solution to thereby form a mixture, and agglomerating the mixture of the dye transfer inhibitor solution and the detergent builder so as to form the dye transfer inhibiting detergent admix.

In another embodiment of the invention, the process further comprises the step of drying the dye transfer inhibiting detergent admix. Additionally, the claimed invention encompasses a process whereby the dye transfer inhibitor solution charged to the mixer/granulator comprises from about 10% to about 100%, by weight of the dye transfer inhibitor solution, of a dye transfer inhibitor. In another embodiment of the invention, from about 5% to about 50% by weight of the dye transfer inhibitor solution is charged to the mixer/granulator.

The claimed invention also encompasses a process wherein the dye transfer inhibitor solution contains a dye transfer inhibitor selected from the group consisting of polyvinyl pyrrolidone polymers, polyamine N-oxide polymers, copolymers of N-vinylpyrrolidone and N-vinylimidazole, and mixtures thereof. The claimed invention also includes using poly(4-vinylpyridine-N-oxide) as a specific dye transfer inhibiting polyamine N-oxide polymer, with the poly(4-vinylpyridine-N-oxide) having a molecular weight of from about 500 to about 1,000,000 and an amine to amine N-oxide ratio of about 1:4. In addition, the density of the dye transfer inhibiting detergent admix can range from about 400 g/l to about 1000 g/l. Moreover, the mean particle size of the dye transfer inhibiting detergent admix is generally from about 150 microns to about 1.200 microns.

In an especially preferred embodiment of the invention, the process comprises the steps of charging from about 65% to about 90% by weight of a zeolite detergent builder into a mixer/granulator; adding to the zeolite detergent builder from about 10% to about 35% by weight of a dye transfer inhibitor solution at a temperature of from about 10° C. to about 50° C., wherein the dye transfer inhibitor solution comprises from about 20% to about 100%, by weight of the solution, of a dye transfer inhibitor; agglomerating the dye transfer inhibitor solution and the zeolite detergent builder so as to form the dye transfer inhibiting detergent admix. This preferred embodiment of the invention can also include the step of drying the dye transfer inhibiting detergent admix.

The invention also includes a free-flowing, particulate dye transfer inhibiting detergent admix produced according to the claimed process.

Accordingly, it is an object of the present invention to provide a process for making a free-flowing, particulate dye transfer inhibiting detergent admix that is cost-effective to manufacture and that can be used to provide desired levels of dye transfer inhibitors to granular laundry products. It is also an object of the present invention to provide a process for making a dye transfer inhibiting particulate admix that will enhance the granular detergent's performance and increase consumer appeal of the total detergent product. It is also an object of the invention to provide a manufacturing process that is safe from dangerous explosions from dry dye transfer inhibitor powders. These and other objects, features and attendant advantages of the present invention will become apparent to those skilled in the detergent art from reading the following detailed description of the preferred embodiment and the appended claims.

All percentage, ratios, and proportions used herein are by weight unless otherwise specified. All documents, including patents and publications, cited herein are incorporated by reference.

DETAILED DESCRIPTION OF THE PREFERRED EMBODIMENT

The process of the present invention comprises three essential steps. First, a detergent builder is charged to a mixer/granulator. Second, a dye transfer inhibitor solution is added to the detergent builder to thereby form a mixture. Finally, the mixture of dye transfer inhibitor solution and detergent builder is agglomerated so as to form the dye transfer inhibiting detergent admix particles. It should be understood that the process described herein can be continuous or batch depending upon the desired application. The individual steps and components of the process claimed herein are described in detail, below.

DETERGENT BUILDER COMPONENT

In the first step of the process for making the free-flowing, particulate dye transfer inhibiting detergent admix, a detergent builder is charged to a mixer/granulator. The detergent builder employed in the process herein aides in controlling mineral hardness when the dye transfer inhibiting admix is added to granular laundry detergents. The builder is also necessary for agglomeration of the dye transfer inhibitor in the process herein. Generally, from about 50% to about 95% by weight of a detergent builder is used in the process, more preferably from about 65% to about 90%, and most preferably from about 77% to about 85%.

Both inorganic and organic builders can be used, however inorganic builders are preferred. Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulfates, and aluminosilicates. However, non-phosphate builders are required in some locales. The process herein works well even when the so-called "underbuilt" builders are used such as zeolites or layered silicates.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6®D is the trademark for a crystalline layered silicate marketed by Hoechst (commonly abbreviated herein as "SKS-6"). Unlike zeolite builders, the NaSKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1} \cdot yH_2O$ wherein M is sodium or hydrogen, x is a number from 1.9 to 4, preferably 2, and y is a number from 0 to 20, preferably 0 can be used herein. Various other layered silicates from Hoechst include NaSKS-5®, NaSKS-74® and NaSKS-11®, as the alpha, beta and gamma forms. As noted above, the delta-$Na_2SiO_5$ (NaSKS-6 form) is a preferred builder.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders include those having the empirical formula:

$$M_z[(zAlO_2)_y] \cdot xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al., issued Oct. 12, 1976. Preferred synthetic crystalline aluminosilicate ion exchange materials useful herein are available under the designations Zeolite A, Zeolite P (B), and Zeolite MAP. In an especially preferred embodiment, the crystalline aluminosilicate ion exchange material has the formula:

$$Na_{12}[(AlO_2)_{12}(SiO_2)_{12}] \cdot xH_2O$$

wherein x is from about 20 to about 30, especially about 27. This especially preferred material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builders can generally be added to the dye transfer inhibitor solution in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al., U.S. Pat. No. 3,635,830, issued Jan. 18, 1972. See also "TMS/IDS" builders of U.S. Pat. No. 4,663,071, issued to Bush et al., on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Citrate builders, e.g., citric acid and soluble salts thereof (particularly sodium salt), are polycarboxylate builders of particular importance due to their availability from renewable resources and their biodegradability. Citrates can also be used in combination with zeolite and/or layered silicate builders. Oxydisuccinates are also especially useful builders.

Other suitable polycarboxylates are disclosed in U.S. Pat. No. 4.144,226, Crutchfield et al., issued Mar. 13, 1979 and in U.S. Pat. No. 3,308,067, Diehl, issued Mar. 7, 1967. See also Diehl U.S. Pat. No. 3,723,322.

DYE TRANSFER INHIBITING SOLUTION

After charging the detergent builder to the mixer/granulator, the next step in the process is to add to the detergent builder a dye transfer inhibitor solution to thereby form a mixture. The invention encompasses adding to the detergent builder a dye transfer inhibitor solution comprising from about 10% to about 100%, more preferably from about 20% to about 100%, and most preferably from about 35% to about 100%, by weight of the dye transfer solution, of a dye transfer inhibiting material and the balance a liquid (e.g., aqueous) medium. For the purposes of the claimed process, polyvinyl alcohols are specifically excluded as part of the liquid media. The temperature of the dye transfer inhibitor solution charged to the mixer/granulator may vary according to the type of dye transfer inhibitor employed and the strength of the solution, however, the dye transfer inhibitor solution temperature will generally range from about 0° C. to about 70° C., more preferably from about 10° C. to about 50° C., and most preferably from about 20° C. to about 25° C. Typically, from about 5% to about 50% by weight of dye transfer inhibitor solution is charged to the mixer/granulator, more preferably from about 10% to about 35%, and most preferably from about 15% to about 23%.

Dye transfer inhibitors useful in the present process include polyvinyl pyrrolidone polymers, polyamine N-oxide polymers, and copolymers of N-vinylpyrrolidone and N-vinylimidazole. In addition, a solution of the above-listed dye transfer inhibitor polymers may also include optical brightener materials, which also have dye transfer inhibiting functionality. Optical brighteners are discussed in greater detail below. Importantly, carboxymethyl cellulose and other cellulose-based materials with dye transfer inhibiting functionality are specifically excluded from the process herein.

The polyamine N-oxide polymers preferred for use herein contain units having the following structural formula: R—$A_x$—P; wherein P is a polymerizable unit to which an N—O group can be attached or the N—O group can form part of the polymerizable unit or the N—O group can be attached to both units; A is one of the following structures: —NC(O), —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

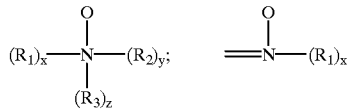

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. The average molecular weight range is determined by light scattering as described in Barth, et al., Chemical Analysis, Vol. 113. "Modern Methods of Polymer Characterization", the disclosures of which are incorporated herein by reference. The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present claimed process for making a free-flowing, particulate dye transfer inhibiting detergent admix may employ as a dye transfer inhibitor polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262.897 and EP-A-256,696, incorporated herein by reference. Materials containing PVP can also contain polyethylene glycol ("PEG") having an average molecular weight from about 500 to about 100,000, preferably from about 1,000 to about 10,000. Preferably, if a combination of PEG and PVP are used in the process to make the dye transfer inhibiting admix, the ratio of PEG to PVP on a ppm basis delivered in wash solutions when the admix is added to granular laundry products is from about 2:1 to about 50:1, and more preferably from about 3:1 to about 10:1.

The claimed process may also utilize certain types of hydrophilic optical brighteners which also provide a dye transfer inhibition action. If used, the process herein will employ from about 0.005% to 5% by weight of such optical brighteners, preferably from about 0.01% to about 1%.

The hydrophilic optical brighteners useful in the present invention are those having the structural formula:

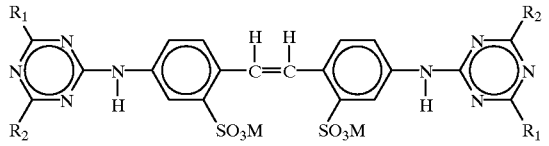

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the process herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

The specific optical brightener species selected for use in the present invention provide especially effective dye transfer inhibition performance benefits when used in combination with the selected polymeric dye transfer inhibiting agents herein before described. When the dye transfer inhibiting admix is added to detergent granules, the combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quick on these fabrics. The extent to which brighteners deposit on fabrics in the wash solution can be defined by a parameter called the "exhaustion coefficient". The exhaustion coefficient is in general the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally be used, in combination with the aforementioned dye transfer inhibitors, in the present process to provide conventional fabric "brightness" benefits, rather than a true dye transfer inhibiting effect. Such usage is conventional and well-known in the detergent art.

AGGLOMERATING STEP

In the process described herein, the detergent builder is charged to a mixer/granulator, a dye transfer inhibitor solution is added to the detergent builder to thereby form a mixture, and the mixture is agglomerated so as to form the dye transfer inhibiting detergent admix. The process steps that lead to making the detergent admix particles can be carried out in the same vessel or in a series of vessels. In one embodiment of the invention, the charging, mixing, and agglomerating steps occur in a single mixer/granulator (e.g., a high-speed mixer/granulator such as a Schugi Flexomix 335). In another embodiment of the invention, the materials are treated first in a high-speed mixer/granulator (e.g., L ödige Recycler CB30), followed by a low or moderate speed mixer/granulator (e.g., Lödige Recycler KM 300 "Ploughshare"). Depending on whether one mixer/granulator or a series of mixer/granulators is used, the residence time of the materials in the mixer/granulator vessel can range from about 0.01 minutes to 15 minutes. If a high-speed mixer/granulator is followed by a low-speed mixer/granulator, then the mean residence time materials in the high-speed vessel if from about 0.06 seconds to about 30 seconds while the mean residence time in the low-speed vessel if from about 0.25 minutes to about 10 minutes. If a single vessel is used, the mean residence time of the starting materials in the vessel is up to about 15 minutes.

The agglomeration step increases the density of the admix particles and the particle size. After agglomeration, the density of the dye transfer inhibiting detergent admix particles is from about 400 g/l to about 1000 g/l, more preferably from about 550 g/l to about 850 g/l, and most preferably from about 650 g/l to about 750 g/l. After agglomeration, the admix particles can be screened to yield particles having a mean size of from about 150 microns to about 1,200 microns, more preferably from about 250 microns to about 1,000 microns, and most preferably from about 400 microns to about 600 microns. If the process is operated continuously, then particles outside the desired size range can be cycled through the process again.

The process herein can optionally contain a drying step wherein the agglomerated dye transfer inhibiting detergent admix particles are dried to a desired level of residual moisture. By "residual moisture" is meant the amount of free water in the admix particles. The residual moisture present in the dye transfer inhibiting admix can comprise from 0% to about 12% by weight of the admix, more preferably from about 3% to about 10%, and most preferably from 5% to about 9%. A drying step can help reduce odor problems by stripping the detergent admix of emanations which might otherwise interfere with perfume formulations in laundry detergent granules to which the admix might be added. If a drying step is employed in the process herein, the temperature at which the detergent admix is dried is critical. Among other problems, drying at too high of a temperature or for too long a period of time can discolor the detergent admix, making the dye transfer inhibiting admix less aesthetically pleasing. Typically, the detergent admix is dried in a standard fluid bed dryer having an inlet fluidizing air temperature of from about 50° C. to about 140° C., more preferably from about 65° C. to about 120° C., and most preferably from about 75° C. to about 110° C. Examples of drying techniques and drying apparatuses useful in the process herein are described in greater detail in *Perry's Chemical Engineers' Handbook* (Sixth Ed., 1984) on pages 8–69 to 8–71, and 20–14 to 20–74, which is incorporated herein by reference.

DETERGENT COMPONENTS

The free-flowing, particulate dye transfer inhibiting detergent admix can be incorporated into a fully formulated granular laundry detergent composition having a variety of common detergent ingredients including a surfactant system. The surfactant system of the granular laundry detergent can include anionic, nonionic, zwitterionic, ampholytic and cationic classes and compatible mixtures thereof. Detergent surfactants are described in U.S. Pat. No. 3,664,961, Norris, issued May 23, 1972, and in U.S. Pat. No. 3,919,678, Laughlin et al., issued Dec. 30, 1975, both of which are incorporated herein by reference. Cationic surfactants include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference.

Nonlimiting examples of surfactant systems include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3$ $(CH_2)_y$ $(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the surfactant system. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

The granular detergent composition to which the dye transfer inhibiting particulate detergent admix can be added can, and preferably does, include a detergent builder. Builders are generally selected from the various water-soluble, alkali metal, ammonium or substituted ammonium phosphates, polyphosphates, phosphonates, polyphosphonates, carbonates, silicates, borates, polyhydroxy sulfonates, polyacetates, carboxylates, and polycarboxylates. Preferred are the alkali metal, especially sodium, salts of the above. Preferred for use herein are the phosphates, carbonates, silicates, $C_{10-18}$ fatty acids, polycarboxylates, and mixtures thereof. More preferred are sodium tripolyphosphate, tetrasodium pyrophosphate, citrate, tartrate mono- and di-succinates, sodium silicate, and mixtures thereof (see below).

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid. Some of these materials are useful as the water-soluble anionic polymer as hereinafter described, but only if in intimate admixture with the nonsoap anionic surfactant.

Other suitable polycarboxylates for use herein are the polyacetal carboxylates described in U.S. Pat. No. 4,144,226, issued Mar. 13, 1979 to Crutchfield et al., and U.S. Pat. No. 4,246,495, issued Mar. 27, 1979 to Crutchfield et al., both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Water-soluble silicate solids represented by the formula $SiO_2 \cdot M_2O$, M being an alkali metal, and having a $SiO_2:M_2O$ weight ratio of from about 0.5 to about 4.0, are useful salts in the detergent granules of the invention at levels of from about 2% to about 15% on an anhydrous weight basis, preferably from about 3% to about 8%. Anhydrous or hydrated particulate silicate can be utilized, as well.

Any number of additional ingredients can also be included as components in the granular detergent composition. These include other detergency builders, bleaches, bleach activators, suds boosters or suds suppressors, anti-tarnish and anti-corrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference.

Suitable smectite clays for use herein are described in U.S. Pat. No. 4,762,645, Tucker et al., issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al., issued May 5, 1987, both incorporated herein by reference.

In order to make the present invention more readily understood, reference is made to the following examples, which are intended to be illustrative only and not intended to be limiting in scope.

EXAMPLE I

A 40% active solution of poly(4-vinylpyridine-N-oxide) at a temperature of 22° C. is metered at a rate of 350 kg/hr through spray nozzles into a Schugi Flexomix 335 high-shear mixer operating at a shaft speed of 2000 r.p.m. Simultaneously, finely divided Zeolite A powder is metered at a rate of 850 kg/hr into the same mixer. The agglomerated particles exiting the high-shear mixer are dried in a standard three zone fluid bed dryer manufactured by Hosakawa Bepex Corporation. The fluidizing air temperature is 82° C. in zones one and two, and 22° C. in zone three. Fine particles elutriated in the fluid bed are recycled to the high-shear mixer. Material with a particle size greater than 1,200 microns is screened from the product, and recycled to the exit of the fluid bed dryer, after passing through a hammer mill. The dye transfer inhibiting detergent admix has low odor, excellent flow properties, a bulk density of 650 g/l, and a composition as presented in Table I:

TABLE I

| Detergent Admix Component | (% Weight) |
|---|---|
| Poly(4-vinylpyridine-N-oxide)[1] | 13.0 |
| Zeolite A | 79.0 |
| Free water | 8.0 |
| Total | 100.0 |

[1]Manufactured under the tradename REILLINE 410 N-OXIDE by Reilly Industries, Inc.

Despite the highly explosive nature of dry poly(4-vinylpyridine-N-oxide), the process equipment is not required to be explosion protected, since the poly(4-vinylpyridine-N-oxide) is maintained in a dilute form at all times during processing. The process for making the dye transfer inhibitor admix works surprisingly well compared to the usual spray-on methods. Unexpectedly, the process provides dye transfer inhibitor admix particles for inclusion in granular laundry products while avoiding the aesthetic problems of discoloration and perfume interference common in spray-on processes.

EXAMPLE 2

A 35% active solution of a 50:50 mixture of poly(4-vinylpyridine-N-oxide) and a copolymer of vinylpyrrolidone and N-vinylimidazole, at a temperature of 22° C. is metered at a rate of 90 kg/hr through spray nozzles into a Schugi Flexomix 100 high-shear mixer operating at a shaft speed of 1,350 r.p.m. Simultaneously, finely divided Zeolite A powder is metered at a rate of 39.5 kg/hr into the same mixer. The agglomerated particles exiting the high-shear mixer are dried batchwise in a Aeromatic fluid bed dryer manufactured by Niro Corporation. The fluidizing air temperature is 80° C. and the batch time is approximately 30 minutes. The dried material is screened between 150–1180 microns. The resulting dye transfer inhibiting detergent admix has low odor, excellent flow properties, a bulk density of 670 g/l, and a composition as presented in Table II:

TABLE II

| Detergent Admix Component | (% Weight) |
|---|---|
| Poly(4-vinylpyridine-N-oxide)[1] | 5.0 |
| Copolymer of vinylpyrrolidone and N-vinylimidazole[2] | 5.0 |
| Zeolite A | 85.0 |
| Free water | 5.0 |
| Total | 100.0 |

[1]Manufactured under the tradename REILLINE 410 N-OXIDE by Reilly Industries, Inc.
[2]Manufactured under the tradename SOKALAN PG55X (solution) by BASF Despite the highly explosive nature of dry polyvinylpyridine-N-oxide and dry copolymer of vinylpyrrolidone and N-vinylimidazole, the process equipment is not required to be explosion protected, since the polymer mixture is maintained in a dilute form at all times during processing. The process for making the dye transfer inhibitor admix works surprisingly well compared to the usual spray-on methods. Unexpectedly, the process provides dye transfer inhibitor admix particles for inclusion in granular laundry products while avoiding the aesthetic problems of discoloration and perfume interference common in spray-on processes.

Having thus described the invention in detail, it will be clear to those skilled in the art that various changes may be made without departing from the scope of the invention and the invention is not to be considered limited to what is described in the specification. The present invention meets the aforementioned needs in the art by providing a dye transfer inhibiting detergent admix for inclusion in granular laundry detergent products which is safe, cost-efficient, aesthetically pleasing to the consumer, and does not interfere with perfume formulations in the granular laundry products to which it may be added.

What is claimed is:

1. A process for making a free-flowing, particulate dye transfer inhibiting detergent admix for inclusion in a granular laundry detergent composition consisting essentially of the steps of:

a) charging from 50% to 95%, by weight of the dye transfer inhibiting detergent admix, of a detergent builder into a mixer/granulator;

b) adding to the detergent builder from 5% to 50%, by weight of the dye transfer inhibiting detergent admix, of a dye transfer inhibitor solution to thereby form a mixture wherein the dye transfer inhibitor solution contains a dye transfer inhibitor selected from the group consisting of polyamine N-oxide polymers, copolymers of N-vinylpyrrolidone and N-vinylimidazole, and mixtures thereof; and c) agglomerating the mixture of the dye transfer inhibitor solution and the detergent builder so as to form the dye transfer inhibiting detergent admix.

2. A process according to claim 1 wherein the dye transfer inhibitor solution comprises from about 10% to about 100% by weight of a dye transfer inhibitor.

3. A process according to claim 1 wherein from about 10% to about 35% by weight of the dye transfer inhibitor solution is charged to the mixer/granulator.

4. A process according to claim 1 wherein the polyamine N-oxide polymer is poly(4-vinylpyridine-N-oxide) having a molecular weight of from about 500 to about 1,000,000 and an amine to amine N-oxide ratio of about 1:4.

5. A process according to claim 1 wherein the density of the dye transfer inhibiting detergent admix is from about 400 g/l to about 1000 g/l.

6. A process according to claim 1 wherein the mean particle size of the dye transfer inhibiting detergent admix is from about 150 microns to about 1,200 microns.

7. A process for making a free-flowing, particulate dye transfer inhibiting detergent admix for inclusion in a granular laundry detergent composition consisting essentially of the steps of:

a) charging from about 65% to about 90% by weight of a zeolite detergent builder into a mixer/granulator;

b) adding to the zeolite detergent builder from about 10% to about 35% by weight of a dye transfer inhibitor solution at a temperature of from about 10° C. to about 50° C., wherein the dye transfer inhibitor solution comprises from about 20% to about 100%, by weight of the solution, of a dye transfer inhibitor selected from the group consisting of polyamine N-oxide polymers, copolymers of N-vinylpyrrolidone and N-vinylimidazole, and mixtures thereof;

c) agglomerating the dye transfer inhibitor solution and the zeolite detergent builder so as to form the dye transfer inhibiting detergent admix.

8. A process according to claim 7 wherein the polyamine N-oxide polymer is poly(4-vinylpyridine-N-oxide) having a molecular weight of from about 500 to about 1,000,000 and an amine to amine N-oxide ratio of about 1:4.

9. A process according to claim 7 wherein the density of the dye transfer inhibiting detergent admix is from about 550 g/l to about 850 g/l.

10. A process according to claim 7 wherein the mean particle size of the dye transfer inhibiting detergent admix is from about 150 microns to about 1,200 microns.

* * * * *